United States Patent [19]

Öttl

[11] 4,270,890

[45] Jun. 2, 1981

[54] APPARATUS FOR CONTROLLING THE HEIGHT OF PRESSED WORKPIECES OF CERAMIC POWDER OR OTHER MATERIAL IN A PRESS

[75] Inventor: Hartmut Öttl, Kochel a. See, Fed. Rep. of Germany

[73] Assignee: Dorst-Keramikmaschinen-Bau, Fed. Rep. of Germany

[21] Appl. No.: 160,294

[22] Filed: Jun. 17, 1980

[30] Foreign Application Priority Data

Jun. 19, 1979 [DE] Fed. Rep. of Germany ..... 2924704

[51] Int. Cl.[3] ..... B30B 11/00; B30B 15/16

[52] U.S. Cl. ..... 425/150; 425/352

[58] Field of Search ..... 425/149, 150, 352

[56] References Cited

U.S. PATENT DOCUMENTS 4,184,827 1/1980 Von Herrmann et al. ..... 425/352

*Primary Examiner*—J. Howard Flint, Jr.

*Attorney, Agent, or Firm*—Price, Heneveld, Huizenga & Cooper

[57] ABSTRACT

A measuring system on a press for making pressings from powder material is designed for cutting out the effects of any stretching of the press frame produced by high pressing forces. A plate supporting one tool part is fixedly supported on a frame and, in relation to the plate, further tool parts may be moved. The measuring system is made up of first measuring elements fixed in relation to the moving tool parts, and second measuring elements, designed for use with the first measuring elements and fixed in relation to the press. The first measuring elements are fixed to the plate or a support on which this plate is itself supported.

1 Claim, 3 Drawing Figures

APPARATUS FOR CONTROLLING THE HEIGHT OF PRESSED WORKPIECES OF CERAMIC POWDER OR OTHER MATERIAL IN A PRESS

BACKGROUND OF INVENTION

The invention is with respect to an apparatus for controlling the height of pressings in a press, and more specially for making pressings using powder material, the apparatus having a frame, in which a plate, supporting a tool part, is fixedly supported, while further tool parts may be moved in relation to the plate, and with a length measuring system which is made up of measuring elements fixed on the moving tool parts, and of further measuring elements, which are fixed in relation to the press and are designed for use with the first-named measuring elements.

Such forms of apparatus for controlling the height of pressings are for example specially important in the case of presses on which pressings are to be made starting with powder ceramic material. It is in fact important that such pressings have generally the same thickness so that, when the later firing operation has been completed, the pressings made from such material are as true to size as possible or, putting it differently, have the smallest possible tolerances, even although shrinkage takes place on firing.

So far measuring elements have been fixedly placed on the moving tool parts, further measuring elements, fixed to the press, being designed for working with the first-named measuring elements and being fixed to the press frame.

However in view of the great pressures taking effect in such presses stretching of the press frame necessarily takes place and the effect of such stretching will necessarily, in turn, have an effect on the readings produced by measuring with the outcome that the height of the pressings may not be truly or exactly controlled.

SHORT OUTLINE OF THE INVENTION

It is in this respect that the system design was made better by the present invention because the measuring elements, fixed in relation to the press, are fixed to the plate or on a support supporting the same.

With respect to the tools, the plate is now that part which is completely at rest and the stretching of the press frame has no effect thereon so that the relation between the two measuring elements is not, from case to case, in any way changed by any stretching of the frame and for this reason the height of the pressings may be kept true to size, that is to say exactly controlled.

DETAILED ACCOUNT OF WORKING EXAMPLES OF INVENTION

An account of the invention will now be given as based on three working examples, to be seen in the drawings of the specification.

Figure 1:
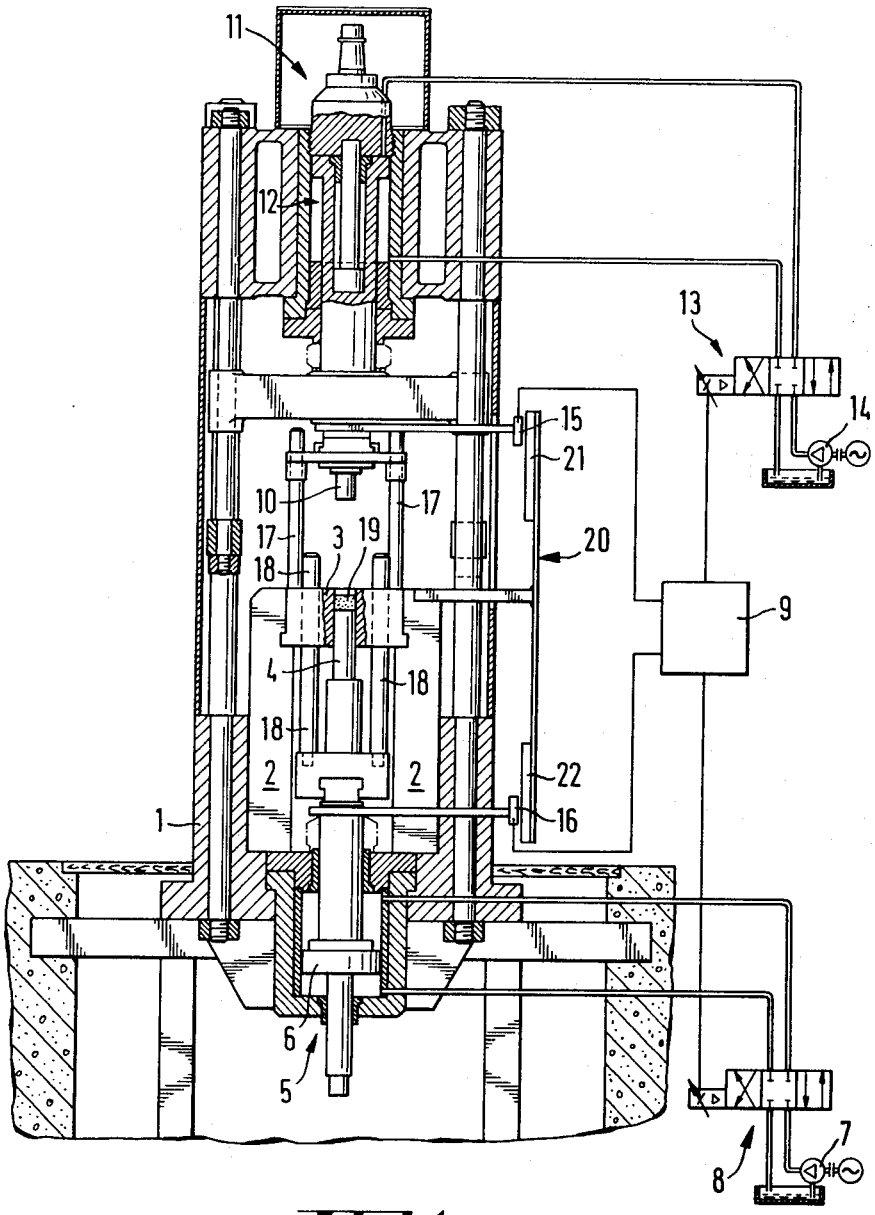
FIG. 1 is a view of a simple example of a press, in which the press female mold is fixed to the plate, used in this connection as a base plate.

In the working example of FIG. 1 a frame 1 is placed round and takes up a plate 2, on which, in the present working example, the female mold 3 is fixedly positioned. Opposite the plate 2 the lower stamp is able to be moved using the piston-cylinder system 5. The motion of the piston 6 is produced by pump 7 by way of servo valve 8, which is joined up with electronic unit 9, of which no detailed account is given herein.

The top stamp 10, acting downwardly, may be moved by the piston and cylinder system 11 upwards and downwards. Its piston 12 is in this respect powered by a pump 14 acting through servo valve 13. Like servo valve 8, servo valve 13 is joined up with the electronic unit 9. Electronic unit 9 is furthermore joined up with the measuring heads 15 and 16.

Linkages 17 and 18 are designed for guiding press parts supporting the top and lower stamps 10 and 4.

The powder to be pressed is placed in the female mold, as marked at 19. Female mold 3, fixedly placed on plate 2, is an unmoving part and, in the present invention, has on it one of measuring elements 20, for example in the form of a measuring arm, which at its ends has measuring bars 21, 22, opposite to which the two separate measuring heads 15 and 16 are moved, which, in each case, are fixedly joined with the top stamp 10 and lower stamp 4. The reader will see that the stretching or increasing length of frame 1 is without any effect on the measuring operation so that the system here presented on a press makes it possible for the height of pressings to be kept fully true to size, the pressings being made from powder 19 placed in the female mold.

The function of the electronic unit 9 is such that using a keyboard (not figured) a desired or ideal value is assigned to each cylinder piston system 5 and, in the other case, 11. Using the measuring systems made up of the measuring bars 21, 22 and measuring heads 15 and 16, a comparison is made by the electronic unit 9 between the measured and the desired size, the servo valve parts 8 and 13 being kept under power till the desired size has been got to by the piston cylinder systems 5 and 11.

Figure 2:
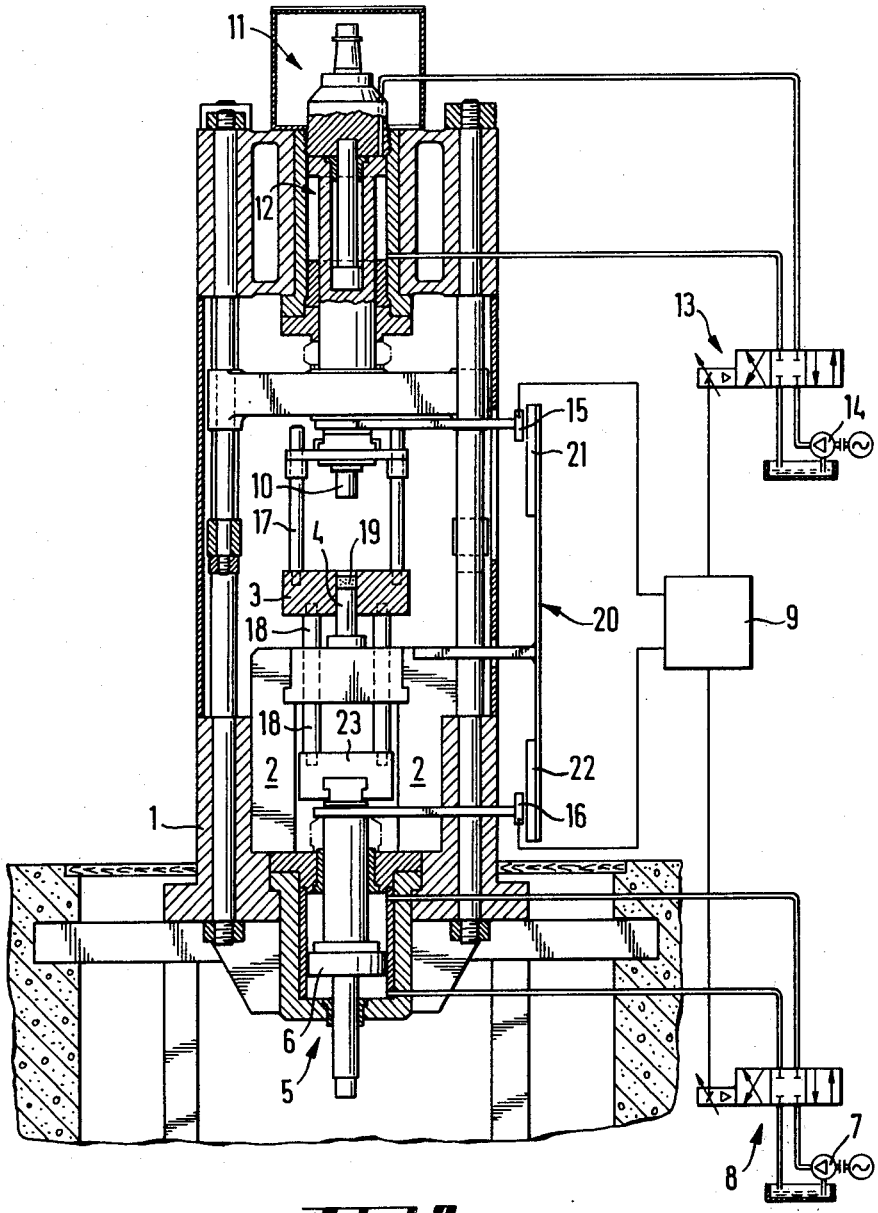
FIG. 2 is a view of a further working example in which the female mold may be moved in relation to the plate.

The working example of FIG. 2 is different to that of FIG. 1 generally speaking only in that female mold 3 may be moved in relation to plate 2, which in this case again is used for supporting only one measuring element 20, while measuring heads 15 and 16 are fixed to the top stamp 10 and, in the other case, on a rest 23 for female mold 3.

Because the working example of FIG. 2 is not in other respects different to that of FIG. 1, an account has only been given of the system parts which are, in fact, different.

Figure 3:
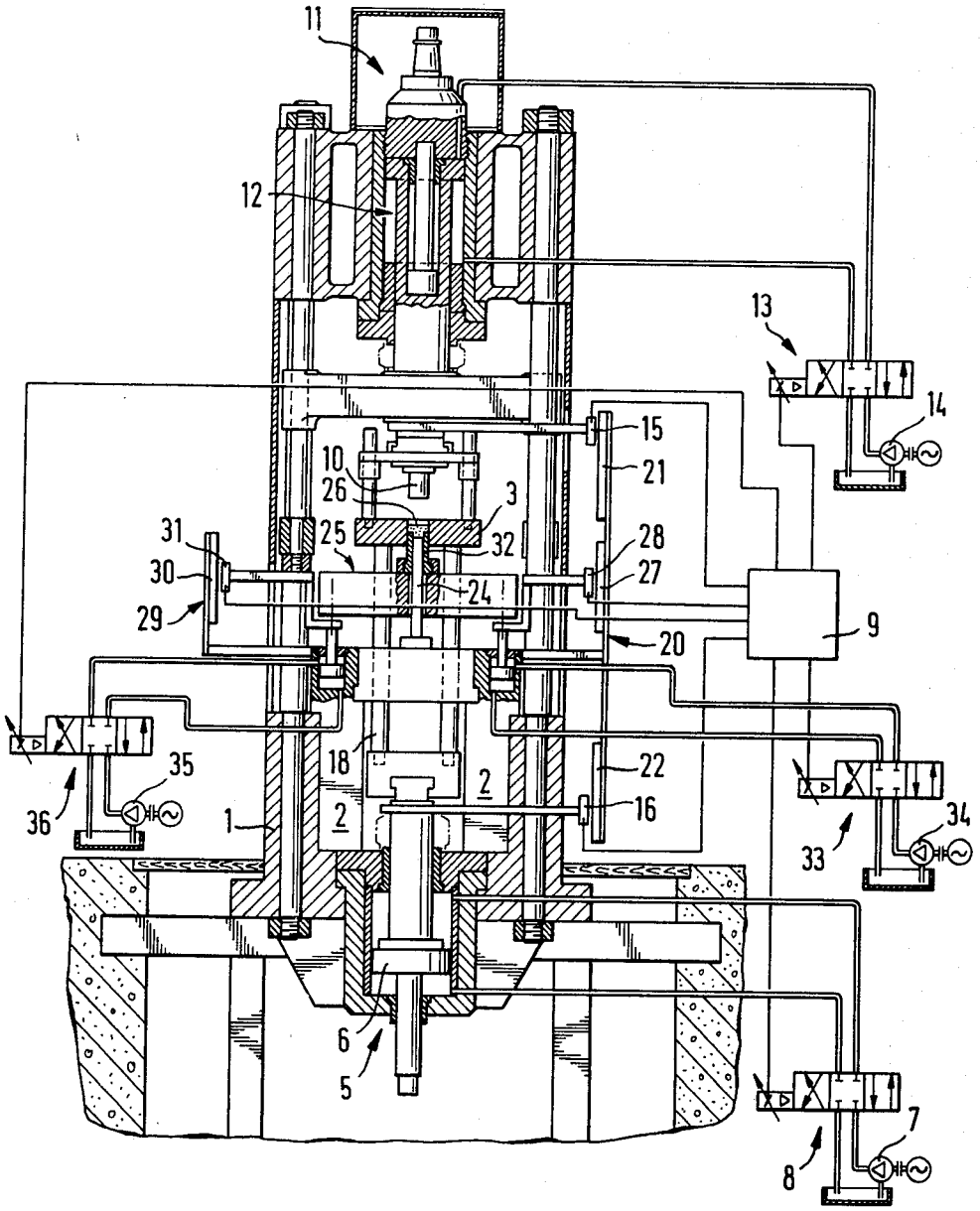
FIG. 3 is a view of an example in which two lower male molds or stamps are used.

In the working example of FIG. 3 two lower punches 24 and 25 are used in order to make it possible for a stepped workpiece (figured at 26) to be produced. Female mold is again numbered 3 and top stamp again with 10. Furthermore the plate is numbered 2 while, again, the frame is numbered 1, because these parts are the same as the parts with the same numbers and functions in the working examples of FIGS. 1 and 2. Because in the present working example a number of size figures have to be kept to or controlled, the measuring element 20, fixed on, or in relation to, plate 2, only has the two measuring arms 21 and 22 on it, used for working with measuring heads 15 and, in the other case, 16 and there is furthermore a further measuring arm 27 for use with the measuring head 28 assigned to the second lower stamp 25. This measuring apparatus, made up of the measuring element 20, fixed in relation to the pressure machine frame, and the further measuring arm 27 with its measuring head 28 may be separately placed on the other side of the press, as is marked in the figure with respect to the measuring element 29, fixed in relation to the machine frame, the measuring arm 30 and its measuring head 31.

The operation of electronic unit 9 is in this respect the same with respect to servo valves 8 with pump 7 and, in the other case, 13 with pump 14. However, there is in addition a pump 34 powering motion of the second lower stamp 25, with the stamp sleeve 32 placed on it, by way of servo valve 33, the last-name being joined up with the electronic unit in the same way as servo valves 8 and 13.

The system to be seen on the left hand side of FIG. 3 and made up of the measuring element 29, measuring arm 30, measuring head 31 and pump 35 together with the servo valve 36 is quite the same as the system made up of the like part of measuring element 20 with measuring arm 27 and measuring head 28 together with their pump 34 with servo valve 33 and is only given in the figure to make it clear that this part may be placed separately at an other position of said press without giving up the general teaching of the invention.

I claim:

1. In a press with tool parts and with an apparatus for controlling the height of pressings to be made by said press from powder and other material, said apparatus having a frame, a plate fixedly supported in said frame and supporting one of said tool parts, other of said tool parts being able to be moved in relation to said plate, and a length measuring system, said measuring system being made up of first measuring elements fixed in relation to said moving tool parts and of second measuring elements fixed in relation to said press and designed for working with said first measuring element, the invention that said second measuring elements fixed to said press are fixed to the plate or to a support supporting said plate.

* * * * *